US008201624B2

(12) United States Patent
Flanders

(10) Patent No.: US 8,201,624 B2
(45) Date of Patent: Jun. 19, 2012

(54) CLUSTERED WELLHEAD TRUNKLINE PROTECTION AND TESTING SYSTEM WITH ESP SPEED CONTROLLER AND EMERGENCY ISOLATION VALVE

(75) Inventor: Patrick S. Flanders, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 12/909,590

(22) Filed: Oct. 21, 2010

(65) Prior Publication Data

US 2011/0061861 A1 Mar. 17, 2011

Related U.S. Application Data

(63) Continuation-in-part of application No. 11/977,204, filed on Oct. 23, 2007, now Pat. No. 7,823,640.

(51) Int. Cl.
*E21B 33/02* (2006.01)
*E21B 34/02* (2006.01)

(52) U.S. Cl. ..... 166/250.01; 700/282

(58) Field of Classification Search ..... 166/250.01, 166/376; 137/14, 486, 487.5; 700/282
See application file for complete search history.

(56) References Cited

U.S. PATENT DOCUMENTS

| | | | | |
|---|---|---|---|---|
| 4,021,700 | A * | 5/1977 | Ellis-Anwyl | 361/28 |
| 4,354,554 | A * | 10/1982 | Calhoun et al. | 166/321 |
| RE32,343 | E * | 2/1987 | Vinzant et al. | 166/322 |
| 4,771,633 | A * | 9/1988 | Jacob | 73/46 |
| 5,335,730 | A * | 8/1994 | Cotham, III | 166/374 |
| 5,983,164 | A * | 11/1999 | Ocondi | 702/12 |
| 7,079,021 | B2 * | 7/2006 | Snowbarger et al. | 340/514 |
| 7,823,640 | B2 * | 11/2010 | Flanders | 166/250.01 |
| 2004/0144543 | A1 | 7/2004 | Appleford et al. | |
| 2005/0166961 | A1 * | 8/2005 | Means et al. | 137/13 |
| 2006/0008355 | A1 * | 1/2006 | Low | 417/36 |
| 2008/0135258 | A1 | 6/2008 | Daniel et al. | |
| 2009/0101338 | A1 | 4/2009 | Flanders et al. | |
| 2009/0121868 | A1 | 5/2009 | Flanders et al. | |

FOREIGN PATENT DOCUMENTS

| | | |
|---|---|---|
| WO | WO 97/09662 A1 | 3/1997 |
| WO | WO 00/29715 A1 | 5/2000 |
| WO | PCT/US08/011698 | 12/2008 |

OTHER PUBLICATIONS

Angela E. Summers, "Wellhead Flowline Pressure Protection Using High Integrity Protective Systems".

International Search Report and Written Opinion, PCT/US2011/056145 dated Mar. 8, 2012 (7 pp.).

* cited by examiner

*Primary Examiner* — Daniel P Stephenson
(74) *Attorney, Agent, or Firm* — Abelman, Frayne & Schwab

(57) ABSTRACT

The systems and processes of the present invention includes ESP variable speed drive controllers that function in conjunction with a safety logic solver, pressure sensors, and an emergency isolation valve to perform a functional test of the complete wellhead trunkline protection system without interruption of production.

22 Claims, 5 Drawing Sheets

CLUSTERED WELLHEAD TRUNKLINE PROTECTION AND TESTING SYSTEM WITH ESP SPEED CONTROLLER AND EMERGENCY ISOLATION VALVE

RELATED APPLICATIONS

The present application is a Continuation-in-Part of U.S. application Ser. No. 11/977,204 filed on Oct. 23, 2007 now U.S. Pat. No. 7,823,640 and entitled "Wellhead Flowline Protection and Testing System with ESP Speed Controller and Emergency Isolation Valve," which is incorporated herein by reference.

BACKGROUND OF THE INVENTION

1. Field of the Invention

This invention relates to a protection and testing system for a wellhead piping trunkline.

2. Description of Related Art

A wellhead high integrity protection system (HIPS) protects flowlines connected to a wellhead from overpressure should a downstream block valve close. The pressure source can be the oil-bearing geologic formation pressure. This pressure is known as the wellhead shut in pressure and it is based on geologic parameters, it is continuous, it cannot be controlled, i.e., it cannot be "turned off" in the conventional sense of that term. Multiple automated block valves are required in series downstream of the wellhead pressure source so that in case one valve leaks or fails to close, another will function to do so.

Although the surface safety valves (SSV) generally used in these applications are extremely reliable, the worst case scenario is considered in the design of safety systems. This is known in the field of safety instrumentation as a design that provides hardware dangerous fault tolerance. In the SSV tight shutoff testing method, valves will not only close, but will actually provide positive shutoff against the constant wellhead pressure, i.e., there will be no detectable leakage. Two series valves are required to allow for a tight shutoff test and the system includes a vent valve between the two series shutdown valves and an intermediate array of pressure transmitting sensors. In certain arrangements of the apparatus and system all of the function components are in communication with, and directed by a safety logic solver (SLS). Command and data signals can be carried over wires or communicated wirelessly.

Electric submersible pump systems and related technologies have been adopted to improve oil/gas recovery when production from the reservoir has been diminished by prevailing reservoir conditions. Downhole electric submersible pumps (ESP) are utilized to lift oil and gas to the surface where they are received by a wellhead flowline system for transportation and distribution. The pipeline pressure, flow rate and numerous other variables are monitored at the wellhead in order to insure, among other things, the safe operation of the pipeline and distribution system downstream of the wellhead. In the immediate vicinity of the wellhead, conventional mechanical protection systems can include the use of thick-walled pipe having an appropriately high pressure rating to withstand the high pressures that can be generated by the ESP. In the interests of economy, the pipeline downstream of the wellhead is fabricated from pipes having a defined lower safe operating pressure range. Relatively thinner walled pipe is used in the flowline system.

One problem that the new downhole ESP production controller introduced was that although it provided the required pressure boost to keep the oil flowing, should an intermediate block valve close in the long network of flowlines and trunklines between an offshore production platform and the onshore gas oil separation plant (GOSP), the pressure would build in the piping network to the pump's fully-blocked discharge pressure which in some cases is much higher than the normal flowing pipeline pressure. A flowline network suited for normal operations may not have a sufficiently high pressure rating to withstand the fully-blocked pressure of the ESP. Therefore, a high integrity protection system is required to limit the pressure in downstream piping to safe levels.

Running downhole pumps against a blocked discharge is not a normal practice, but is considered the worst case scenario when designing associated safety systems. The downhole ESPs are electrically driven and control of the pump as a potential source of dangerous pressure is electrical.

In order to insure the maximum flowline pressure remains within safe operations, so-called high integrity protection systems, or HIPS, have been developed for various applications. The conventional safety design practice of the prior art has been to specify flowlines that transport produced oil/gas from wellheads with sufficient wall thickness to contain the fully-blocked discharge pressure under theoretically possible worst case conditions. However, this approach proved to be impractical with the introduction of electric submersible pumps that can produce a very high wellhead shut-in pressure greater than 3000 psi. One approach that has been adopted is to continuously monitor the downstream flowline pressure and cut the power supply to the ESP before the flowline pressure reaches a dangerous level.

It is also known in the prior art to provide sub-surface safety valves (SSSV) for the purpose of shutting in the well and testing of these types of valves has been disclosed for the purpose of ensuring that the wellhead shutdown system will function properly, as for example in U.S. Pat. No. 4,771,633.

Other systems have been disclosed to allow the electric submersible pump to continue to operate in a re-circulation mode in the event of an emergency that requires the well to be shut in. Such systems are disclosed in U.S. Pat. No. RE 32,343 and U.S. Pat. No. 4,354,554.

Systems are also known for use in conducting an emergency shut down test of safety shut-off valves. For example, U.S. Pat. No. 7,079,021 discloses an emergency shut-down device controller and sensors to provide data to the controller, the controller having a processor, a memory coupled to the processor and an auxiliary input, wherein an emergency shutdown test is stored in the memory, and the auxiliary input is adapted to receive a binary signal and sensor data. Routines are stored in the memory and are adapted to be executed on the processor to allow the emergency shutdown test to be performed in response to the receipt of a binary signal at the auxiliary input and to cause sensor data to be recorded in the memory during the emergency shutdown test.

The above-described problems and proposed solutions are directed to individual wellhead flowline systems. Parent patent application U.S. Ser. No. 11/977,204, which is incorporated herein by reference, provides a wellhead flowline protection system and method that utilizes the downhole ESP speed controller and an SSV to ensure that dangerous pressure levels are not reached and provides for functional safety testing of the wellhead system. However, a unique problem arises in the context of a group of wellheads that are connected to a common trunkline. The maximum risk reduction criteria allowances combined with the required functional testing and maintenance of each HIPS creates both a practical and a design limitation that does not allow for more than a predetermined number of HIPS along a particular trunkline.

It would be desirable to provide oil/gas operations that utilize electric submersible pumps with a wellhead flowline protection system that is capable of providing fully automated proof-testing and self-diagnostics for a plurality of wells without the need for shutting in the plural wells for the purpose of conducting the test. The "online" testing can be performed at a regular interval, e.g., quarterly, combined with full, shut-in system verification during periods where production is shut down for scheduled, routine maintenance, testing and/or inspection.

It is therefore an object of the present invention to provide a wellhead control system and a method for the continuous monitoring and automatic testing for potential faults in a flowline associated with a cluster of wells each pressurized by an electric submersible pump while continuing the operation of the ESPs.

A further object of the present invention is to provide a reliable, automated testing and shutdown system to replace the instrumented flowline protection systems of the prior art which require production to be interrupted, significant manpower and that are based upon complicated manual proof-testing requirements.

Another object of the invention is to provide a safety test procedure for a cluster of wells each having an ESP that can be performed without interrupting production by turning off the ESP.

Yet another object of the present invention is to eliminate the dependence on manual human intervention for proof-testing of the system by providing an automatic functional testing and diagnostic method and system.

SUMMARY OF THE INVENTION

In accordance with one or more embodiments, the invention relates to an automated system for the safety testing of a trunkline instrumented protection system connected to a plurality of wellhead piping flowlines employed for the distribution of a fluid stream of gas and/or oil. At least one wellhead piping flowline of the plurality of wellhead piping flowlines is pressurized by a downhole electric submersible pump (ESP). Plural of wellhead piping flowlines are connected to a common header. An emergency isolation valve (ZV) is positioned in a trunkline downstream of the common header. A pre-programmed safety logic solver (SLS) is provided for conducting a safety test protocol and recording the results electronically, and for issuing emergency shut-down signals. Plural of pressure sensors are included for measuring the internal flowline pressure in the common header. Further, a valve actuator is provided for closing the ZV in response to either a test-initiating signal or an emergency shut-down signal transmitted by the SLS and for opening each ZV in response to a signal transmitted by the SLS. Each ESP includes operatively connected thereto a variable speed drive controller, which is also connected to the SLS, and serves to vary the speed of the ESP based upon incremental speed reduction/increase commands from the SLS to thereby varying the pressure of the fluid in the flowline, and for providing feedback of the speed of the ESP during normal operations and during system testing to the SLS. An emergency ESP shut-off switch is provided for interrupting power to each ESP in response to an emergency shut-down signal from the SLS.

BRIEF DESCRIPTION OF THE DRAWINGS

The invention will be described in further detail below and with reference to the attached drawings in which the same or similar elements are referred to by the same number, and where.

DETAILED DESCRIPTION OF THE INVENTION

Figure 1:
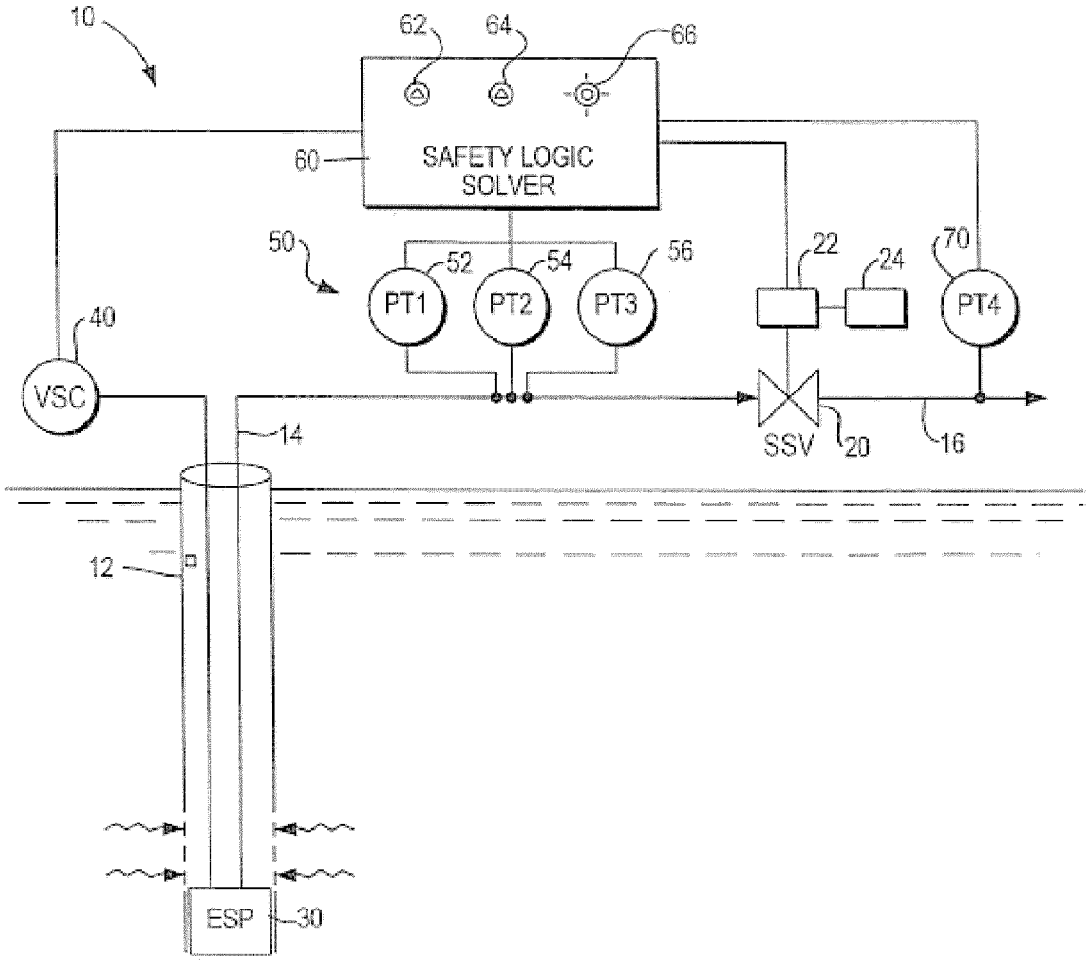
FIG. 1 is a schematic illustration of a wellhead flowline piping arrangement pressurized by an electric submersible pump, the arrangement including an embodiment of a wellhead high integrity protection system.

The systems and processes of the present invention includes ESP variable speed drive controllers that function in conjunction with a safety logic solver (SLS), pressure sensors, and an emergency isolation valve (ZV) to perform a functional test of the complete wellhead flowline protection system without interruption of production.

In the context of a high integrity protection system associated with a single well, the term "final elements" include an ESP, a variable speed drive controller (VSC), and a safety shut-off valve (SSV). These final elements and the wellhead itself are collectively referred to herein as a "wellhead sub-system" in the context of a high integrity protection system associated with a single well.

In the context of a high integrity protection system associated with a plurality of wells, the term "final elements" refers to the ESP(s), the VSC(s), and the ZV. The ESP(s), the variable speed drive controller(s), and the wellhead itself, including the conventional SSV(s) and subsurface safety shut-off valve(s) SSSV(s), are collectively referred to herein as a "wellhead sub-system" in the context of a high integrity protection system associated with a plurality of wells.

In certain embodiments of the system and process of the present invention, one high integrity protection system is used for a single wellhead sub-system. In additional embodiments of the system and process of the present invention, one high integrity protection system is used for a plurality of wellhead sub-systems.

The principal steps of performing a safety test in a high integrity protection system associated with a single well having an ESP include: (1) closing the SSV; (2) ramping down the ESP using the VSC; (3) opening the SSV; and (4) ramping up the ESP to normal operating speed. During the testing of the final elements, the process sensors transmit data to the safety logic solver on the pressure in the flowline.

The principal steps of performing a safety test in a high integrity protection system associated with a plurality of wells each having an ESP and under control of the SLS include: (1) moving the ZV within the production header from the fully open position toward a partially closed position; (2) monitoring the differential pressure across the ZV until pressure sensors upstream of the production header and at least one pressure sensor downstream of the production header reach a predetermined value; (3) ceasing ZV travel, since the ZV is in a partially closed position, i.e., not fully closed; (4) aborting the test if the differential pressure across the ZV was not detected when a default maximum ZV travel limit is reached; (5) monitoring pressure sensors upstream of the production header for pressure increase within the production header (i.e., high-pressure rated trunkline upstream of the ZV) with all ESPs running at normal speed and the ZV in a partially closed position; (6) measuring and recording the normal operating speed of all ESPs; (7) decreasing/ramping down the ESP speed for each well using the associated VSC by a predetermined increment; (8) measuring and recording the ESP speed for each well; (9) determining if the ESP test speed is less than the ESP normal speed, and, if any of the ESPs did not respond to the initial speed reduction instruction from the SLS (step (7)), aborting the test and indicating on a control panel of the SLS the identity of the ESP(s) that did not respond; (10) decreasing the ESP speed of each well by an additional predetermined increment until the pressure sensors upstream of the production header measure a pressure decrease in the production header; (11) checking the number of incremental ESP speed reductions against a preset minimum ESP test speed limit, and aborting the test and indicating a fault on the control panel if the ESP speed is reduced to the minimum ESP test speed limit value and no pressure decrease was detected by the pressure sensors upstream of the production header; (12) moving the ZV from the partially closed "test" position to the fully open position, and maintaining ESP speed at the test value and indicating a ZV fault on the control panel if the ZV does not begin to move from the partial stroke test position within a predetermined period of time; (13) returning all ESPs to the normal operating speed provided that the ZV begins to travel to the fully open position; (14) verifying that all ESPs returned to the normal operating speed as recorded within the SLS in step (6), and indicating an alarm if any ESP did not return to the normal operating speed; and (15) verifying that the ZV returned to the fully open position, and indicating a ZV fault if the ZV did not move within a predetermined period of time or if the ZV failed to reach the fully open position. During the testing of the final elements, the pressure sensors upstream of the ZV transmit data to the SLS indicative of the pressure in the trunkline. The pressure sensors provide updates of the process pressure on a substantially continuous basis to the SLS during both testing and normal operations, e.g., with updates provided with each scan of the SLS, typically 100 mS.

In the system described herein, pressure sensors and SLSs are commercially available as certified devices from multiple suppliers, e.g., certified by TÜV Rheinland Group (Cologne, Germany) and/or TÜV SÜD Group (Munich, Germany). The EPS VSCs and the ZV, including the valve, actuator, and controller assembly, are not currently available as third-party safety certified devices. Therefore, functional testing is of critical importance to the operational safety of the wellhead sub-system, the production header, the production trunkline and the downstream trunkline (i.e., that which is rated at a lower pressure than the maximum shut-in pressure).

The system and process of the present invention provides for an "on-line" system functional test that can be conducted without interruption of production. Production interruption for system functional testing is generally not acceptable when multiple ESP wells contribute to a common production header and a single HIPS is used to protect the downstream piping. The system and process of the present invention allows for on-line testing to be conducted frequently, e.g., monthly, bi-monthly or quarterly, via partial stroke of the ZV, speed reduction of the ESP, and measurement verification of the pressure sensors in between the "full" functional tests conducted during planned testing and maintenance when production is shut down. The full functional tests (performed with production shutdown) include full closure of the ZV, full stoppage of the ESP's, and tripping of the conventional wellhead shutdown system with associated closures of the SSV and SSSV on each well. Therefore, both online and full functional testing are combined to provide the system performance verification required to meet a desired risk reduction goal.

In additional embodiments of the system and method of the present invention, a safety protocol known as "FF-SIF" is employed. The FF-SIF standards provide for individual device self-diagnostics and communications of data from the devices that monitor and control the process. While the adoption and application of this new safety communications standard to the present invention is within the ordinary skill of one in the art, the details of its deployment is beyond the scope of the present invention.

The system and method of the present invention contemplates a self-testing high integrity protection system to protect ESP wellhead flowlines by utilizing redundant pressure sensors, a safety logic solver, and diverse final elements. Final elements include a ZV and an ESP variable speed controller associated with each producing well. These final elements employ different technology to protect the lower rated flowline piping from overpressure. In embodiments in which one high integrity protection system is used to protect a production trunkline from potential overpressure due to multiple ESP wells, a SLS is used in combination with a plurality of redundant pressure sensors (e.g., three) positioned downstream of the production header and upstream of a ZV. The pressure sensors are included within the fully pressure rated production header and trunkline. Deployment of the systems and methods of the present invention provide a safety system that will meet both safety and operability requirements, in that devices that are not subject to standard certification procedures such as certification by TÜV Rheinland Group and/or TÜV SÜD Group are tested under control of the SLS without production interruption (on-line testing) in addition to full functional tests that are conducted during planned testing and maintenance when production is shut down.

In certain embodiments, three pressure sensing transmitters are positioned upstream of the ZV to monitor the flowline for high and low pressure and are voted in a two-out-of-three protocol by the SLS. Using this system, a failure of one of the pressure sensors or a failure to detect an internal fault will result in the signal from that sensor being discounted, and the process will remain on line and the remaining two sensors will continue to protect the system. The SLS is also programmed to recognize the defect or failure of the single sensor and alert maintenance personnel via a suitable indicator, e.g. an audible and/or visible alarm, text message to operating personnel, or other known safety procedures. During any such time as when a sensor is in a known failure mode, the system converts to a voted one-out-of-two protocol.

Referring now to FIG. 1, a system 10 is depicted including a wellbore casing 12 from which extends a production tubing 14 that is constructed from a high pressure rated piping that terminates at surface safety shut-off valve 20. Downstream of the SSV 20, conventional piping 16 rated for a lower pressure as compared to the maximum wellhead shut-in pressure is installed for the transportation and distribution of the product.

The downhole end of production tubing 14 is attached to electric submersible pump 30 which delivers the pressurized stream of reservoir gas and/or oil for eventual transportation and distribution through the downstream flowline piping network. In accordance with the invention, a variable speed drive controller 40 is operatively connected to downhole pump 30 and also to a safety logic solver (SLS) 60.

In general, and as described in further detail below, the SLS 60 will run through a pre-programmed set of diagnostic tests of the final elements, while monitoring a plurality of flowline pressure sensors. The system and method of the invention provides for an end-to-end functional safety check of the final elements and the plurality of sensors. In addition, the SLS 60 itself can also be tested during the functional test, in that the ability of the SLS to receive information from the sensors and to command action to the final elements is verified.

In one embodiment, a method of performing safety tests and providing system emergency isolation protection using the system 10 includes the step of using a plurality of pressure transmitters 50 to monitor the flowline pressure during normal operations and during a full stroke test of the safety shutoff valve 20, and adjusting the speed of the downhole ESP 30 during the test to maintain the pipeline pressure within predetermined operating pressure limits. This wellhead flowline protection system and method generally utilizes the downhole ESP VSC 40 and an SSV 20 to ensure that dangerous pressure levels are not reached in the downstream piping 16 and provides for full functional safety testing of the wellhead sub-system. The ESP VSC 40 is used to permit functional testing and remove the pressure source from protected downstream flowline piping.

A plurality of pressure transmitting sensors 50 are installed on the high pressure rated flowline piping 14 and are in data communication with safety logic solver 60. In the embodiment illustrated, three pressure sensors 52, 54, 56, (also identified as PT1, PT2 and PT3), are installed; in addition, a fourth pressure sensor 70 (PT4) is installed downstream of safety shut off valve on the low pressure rated flowline 16 and in data communication with SLS 60. Note that although a plurality of pressure sensors are shown on the high pressure rated flowline piping 14 as a preferred embodiment, it is contemplated that certain embodiments can operate with one pressure sensor. To accommodate enhanced safety, one or more pressure sensors can be provided as backups.

A valve actuator 22 is installed on valve 20 and is in controlled communication with SLS 60. In this embodiment, the valve actuator is also equipped with limit switch 24 to indicate the SSV fully-opened and fully-closed positions, which are communicated to the SLS 60.

The pre-programmed SLS 60 includes a local trip switch 62, which is conveniently a push button, for initiating a safety shutdown when an emergency condition exists. Pressing the push button 62 will result in actuator 22 closing SSV 20 and terminating power to the ESP 30 to promptly reduce the pressure in flowline 14.

A local functional test push button switch 64 is provided for initiating the functional and safety testing of the system in the field. Functional testing of the system can also be initiated automatically utilizing the programmed SLS 60, or remotely from a central control room.

Also illustrated is a local fault indicator 66 which, in certain embodiments, includes a light and an audible alarm. The alarm can also be transmitted via wired circuits or wirelessly to a remote control room to determine whether any additional action is required to continue the safe operation of the system.

During normal operations, the pressure transmitters 52, 54 and 56 monitor flowline pressure for any unusual variations that may require a safety response; the pressure transmitter 70 which is downstream of the SSV is a non-safety related transmitter that is used to monitor flowline pressure during SSV testing.

It will be understood that the SLS 60 includes a pre-programmed functional test protocol without the need for personnel involvement in the step-by-step effectuation of the test. The programmed safety test includes timed intervals of predetermined length and the immediate initiation of one of predetermined alternative actions in the event that specified conditions are not met within the clocked interval. As will be understood by one of ordinary skill in the art, the conduct of such tests by personnel using visual observation methods with step-by-step personnel-controlled procedures, stopwatches, and the like cannot compare with the timeliness and accuracy of a programmed protocol. The functional tests can be initiated remotely from a control room; automatically by the predetermined periodic initiation of the test, e.g., monthly at a specified time and date in accordance with the program installed on the safety logic solver; or by field personnel using the push button 64.

The SLS 60 includes as a protocol a pre-programmed set of diagnostic tests of the final elements, which are conducted while monitoring the flowline pressure sensors. The system and method of the invention provides for an end-to-end functional safety check of the complete system, including the final elements, a logic solver, and a plurality of sensors.

Upon initiation of the function test at the wellhead site, e.g., manually with a push button or other switch, or electronically from a remote location, actuator 22 receives a signal to initiate closing of the valve 20. The SLS 60 initiates a full stroke of the SSV 20 from the open to the closed position. A signal is transmitted by indicator 24 upon movement of the valve from the fully opened position.

While SSV 20 is traveling from the open to the closed position, valve response data (position vs. time) is collected and stored by SLS 60. This data, known as the valve signature, can be used to diagnose changes in the valve performance that can indicate degraded performance and a potential for failure. If the valve fails to move or excess delay is indicated, an alarm is initiated by the SLS 60 and annunciated locally, e.g., using local fault indicator 66, to indicate that the system failed the functional test.

When the SSV 20 reaches the closed position as verified, e.g., by the integral actuator limit switch 22, the pressure sensors 50 will indicate an increase in pressure because the ESP 30 is now running against the closed valve 22. In addition, the pressure is monitored using pressure sensor 70 upstream of the closed valve 20 for an increase in differential pressure (e.g., between pressure sensors 52, 54, 56 and pressure sensor 70) to verify proper valve seating and valve stem position.

Once the "valve closed" limit is reached, a predetermined test period is initiated by the SLS 60 during which the pressure increase is monitored. Signals from the pressure transmitters 52, 54, 56 are monitored for detection of a pressure increase. When the predetermined pressure value or increase is detected, the SLS 60 will send a command to the ESP speed controller 40 to reduce the speed of the ESP 30.

If a pressure increase is not detected, the test is aborted and a "test failed" alarm is initiated. In this test protocol, it is not necessary to verify a SSV "tight shutoff." However, the ability to fully close and develop an increase in pressure in the upstream piping resulting in differential pressure across the valve is a sufficient functional test for the safety application of the present invention.

Once the SSV 20 is fully closed and the flowline pressure increase is successfully detected, the SLS 60 sends a command signal to the ESP variable speed controller 40 to ramp down the speed of the ESP 30. Starting with the output from the SLS 60 to the ESP speed controller 40, a predetermined time period is provided to detect a decrease in pressure in line 14 based upon data received from the pressure transmitters 52, 54 and 56. If a decrease in pressure is not detected during the time allotted, the SLS 60 will open the SSV 20 and initiate a "test failed" alarm. If a pressure decrease is detected, the ESP variable speed controller 40 is deemed to have passed the functional test, including verification of the fact that the ESP variable speed controller 40 is properly responding to commands from the SLS 60. Thus, the test method includes the ability to decrease the pump speed, detect the pressure drop upstream of the closed SSV 20, and return the pump speed to normal.

Following the detection of the pressure drop, the SLS 60 will transmit a signal to reopen the SSV 20. A predetermined time period is provided for the valve to initiate movement from the closed limit switch position. Should the valve fail to move before the time period elapses, the SLS 60 will completely shut down the ESP 30. Should the valve 20 fail to completely return to the fully open position, a fault alarm will be initiated, but the ESP 30 will be returned to the predetermined normal operating speed and the flowline pressure will continue to be monitored by the SLS 60.

When the SLS 60 receives a signal from the actuator limit switch 22 indicating that the SSV 20 has moved from the closed position to the open position, a signal is transmitted to the variable speed controller 40 to ramp up the speed of the ESP 30 to provide the desired normal operating flowline pressure as verified by pressure transmitter 70.

Accordingly, using the protocol of the SLS 60, all components that constitute the safety instrumented system (SIS), including the pressure sensors on the input side, the safety logic solver, and the diverse outputs, e.g., the single surface safety shut-off valve and the ESP variable speed controller, are tested.

In certain embodiments of the systems and processes of the present invention, performance characteristics of the pump 30, e.g., efficiency, flow rate and the like, need not be measured. Rather, it is the overall response of the pump 30 to the programmed signals transmitted from the SLS 60 that are determinative of the condition of the safety system. The flowline pressure is sensed with safety-critical pressure transmitters 50 upstream of the SSV 20. Signals from the pressure sensors 50 are transmitted to the SLS 60 for a determination of whether the pump 30 is responding within acceptable limits to the command signals from the SLS 60.

In the event that a safety demand signal is generated during the SSV full-stroke test or the pump speed ramp test, the emergency shutdown trip signal will override the test sequence protocol and bring the pump 30 to a full stop and stroke the SSV 20 to the fully closed position.

It will be understood that the fault indicator 60 will provide an alarm and register a time-stamped fault in the memory of the safety logic solver in the event that the limit switch 24 fails to register a fully-opened or a fully-closed condition in the safety shut-off valve 20. Faults will also be registered and alarmed in the event that no pressure increase is detected by 52, 54 and 56 as the SSV 20 is moved to the closed position or if no pressure decrease is detected, after the slowing of the pump speed has been signaled to the variable speed drive 40. Other diagnostics include delays in valve travel from either the open or closed positions that exceed the predefined time limit.

Should an emergency shutdown signal be received by SLS 60, e.g., as a result of tripping of the actuator 62, e.g., a push button, by personnel at the site, or the transmission via wire or wirelessly, of an emergency shut down signal, the conduct of the safety and fault test is immediately overridden and the SLS 60 sends a signal to shut down the ESP 30 and to close the emergency isolation valve 20. In certain embodiments, the variable speed drive 40 is included in the emergency shut down program so that the speed of the ESP 30 is slowed before the electrical power is interrupted. This reduces the potential for any adverse impact on the pump 30 that might occur by simply switching off the power.

Figure 2:
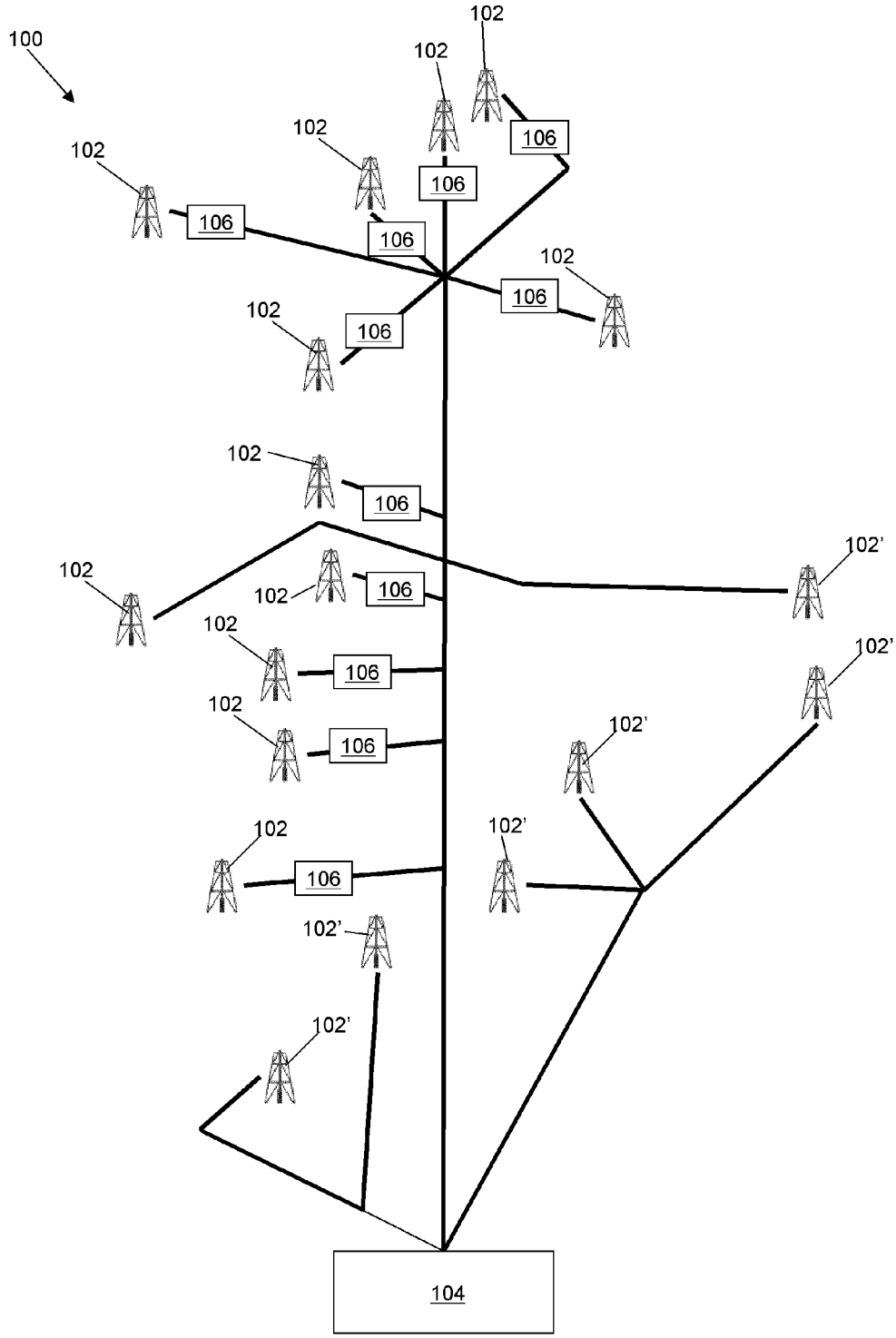
FIG. 2 is a schematic illustration of a plurality of wellheads connected to a common trunkline in which certain wellheads include the wellhead high integrity protection system of FIG. 1.

Referring now to FIG. 2, a system 100 includes a plurality of wellhead sub-systems 102 and 102' that are typically connected to a common trunkline to transport the oil/gas to a gas oil separation plant (GOSP) 104. Wellhead sub-systems 102 each include associated therewith a HIPS 106, e.g., including an SLS, pressure transmitters and SSV as shown in FIG. 1. As described with respect to FIG. 1, high pressure rated piping is used between the well and the SSV of the HIPS 106, and conventional piping is used downstream of the SSV of the HIPS 106, which is rated for a lower pressure and suitable for the transportation and distribution of the product. In certain systems 100, additional wellhead sub-systems 102' are provided that do not show an associated HIPS 106, although other protection and/or safety systems can be used for these wellheads as is within the ordinary skill of one in the art.

Figure 3:
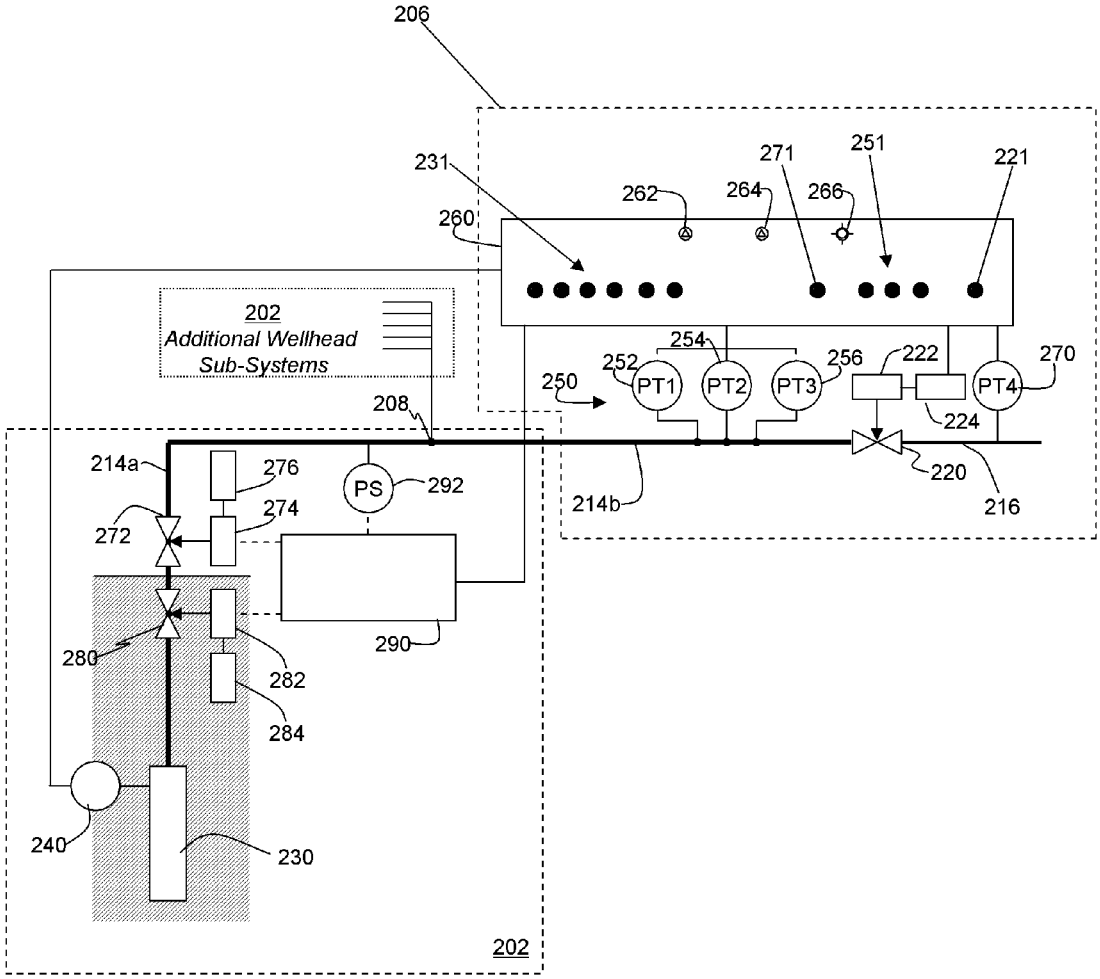
FIG. 3 is a schematic illustration of another embodiment of a wellhead high integrity protection system suitable for use with a plurality of wellhead flowline piping arrangements each pressurized by an electric submersible pump.

Referring now to FIG. 3, a high integrity protection system 206 is depicted for association with a plurality of wellhead sub-systems 202. The plurality of wellhead sub-systems 202 are connected at a common header 208, which serves as a transition between individual wells to the combined production header in which the HIPS 206 and ZV 220 are located. The wellhead sub-system 202 includes, as shown in conjunction with FIG. 1, a wellbore casing (not shown) from which extends a production tubing 214*a*, 214*b* that is constructed from a high pressure rated piping that terminates at an emergency safety shut-off valve (ZV) 220, wherein tubing 214*a* is the production tubing upstream of the common header 208 and tubing 214*b* is the production tubing downstream of the common header 208. HIPS 206 generally includes ZV 220, a SLS 260, a plurality of pressure sensors 250 upstream of ZV 220 and a pressure sensor 270 downstream of ZV 220. Note that although a plurality of pressure sensors are shown upstream of ZV 220, i.e., on the high pressure rated piping, as a preferred embodiment, it is contemplated that certain embodiments can operate with one pressure sensor. To accommodate enhanced safety, one or more pressure sensors can be provided as backups.

As shown, the common header 208 is upstream of the HIPS 206. Downstream of the ZV 220, conventional piping 216 rated for a lower pressure as compared to the maximum topside ESP blocked discharge pressure is installed for the transportation and distribution of the product.

In the line of the high pressure rated production tubing 214*a* of each individual well, an SSV 272 is included, and optionally, a subsurface safety shut-off valve (SSSV) 280 can be provided. Each SSV 272 and SSSV 280 individually communicate with SLS 260 via a wellhead shutdown interface 290 to reduce the impact in the event if a downstream flowline rupture. A pressure sensor 292 is also provided to indicate the pressure within each individual well production line. This sensor is typically used within the wellhead shutdown system to initiate closure of the individual well SSV and SSSV when required without impacting production from the other wells that share a common wellhead shutdown system cabinet. The downhole end of production tubing 214*a* is in fluid communication with ESP 230 which delivers the pressurized stream of reservoir gas and/or oil for eventual transportation and distribution through the downstream flowline piping network. In accordance with the invention, a variable speed drive controller (VSC) 240 is operatively connected to downhole ESP 230 and also to a SLS 260.

In general, and as described in further detail below, a preprogrammed set of diagnostic tests of the final elements of the plural wellhead sub-systems 202 are conducted under control of SLS 260, while monitoring a plurality of flowline pressure sensors. The system and method of the invention provides for a functional safety check of the final elements and the plurality of sensors. In addition, the SLS 260 itself can also be tested during the functional test, in that the ability of the SLS to receive information from the sensors and to command action to the final elements is verified.

In one embodiment, a method of performing safety tests and providing system emergency isolation protection using the system 206 includes the step of using a plurality of pressure transmitters to monitor the collective flowline pressure during normal operations and during a partial stroke test of ZV 220. Further, the speed of the downhole ESP 230 is adjusted during the test to maintain the pipeline pressure within predetermined safe and operational pressure limits. This wellhead flowline protection system and method generally utilizes the downhole ESP speed controller 240 associated with each wellhead sub-system 202 and the ZV 220 to ensure that dangerous pressure levels are not reached and provides for on-line functional safety testing by the HIPS installed to protect downstream piping from dangerous overpressure. The ESP motor speed controller 240 associated with each wellhead sub-system 202 is used to permit functional testing and remove the pressure source from protected downstream flowline piping.

A plurality of pressure transmitting sensors 250 are installed on the high pressure rated flowline piping 214 and are in data communication with safety logic solver 260. In the embodiment illustrated, three pressure sensors 252, 254, 256, (also identified as PT1, PT2 and PT3), are installed. In addition, a fourth pressure sensor 270 (PT4) is installed downstream of ZV 220 on the low pressure rated flowline 216 and in data communication with SLS 260.

A valve actuator 222 is installed on valve 220 and is in controlled communication with SLS 260. In certain embodiments, valve actuator 222 is equipped with a limit switch 224 to indicate the ZV fully-opened or fully-closed position, which is communicated to SLS 260. In additional embodiments, valve actuator 222 is equipped with a smart valve controller and limit switch 224 to indicate the ZV fully-opened or fully-closed position, control the ZV valve stroke during testing, and characterize the valve performance during on-line testing, all of which are communicated to SLS 260. As described herein in certain embodiments, the ZV uses an electronic smart valve controller to provide valve stroke characterization improvements required for partial stroke testing. Communications between the SLS and the transmitters of the pressure process sensors, the ESP controllers, and the ZV can be hardwired or wireless.

In addition, a valve actuator 274 and a limit switch 276 are also installed on valve 272, and are in controlled communication with SLS 260, e.g., via wellhead shutdown interface 290. Similarly, a valve actuator 282 and a limit switch 284 are installed on the optional valve 280, and are in controlled communication with SLS 260, e.g., via wellhead shutdown interface 290. During a safety demand initiated by SLS 260 based on data from pressure sensors 252, 254, 256, or via a panel trip button, SLS 260 closes the ZV 220, ramps the ESPs 230 to the fully stopped speed, and initiates a trip of the wellhead shutdown system. The wellhead shutdown system then in turn closes all SSVs and SSSVs.

The pre-programmed SLS 260 includes a local trip switch 262, which can be a push button, for initiating a safety shutdown when an emergency condition exists. Pressing the push button 262 will result in actuator 222 closing ZV 220 and terminating power to each ESP 230 to promptly reduce the pressure in flowline 214.

A local functional test push button switch 264 is provided for initiating the functional and safety testing of the HIPS system in the field. Functional testing of the HIPS system can also be initiated automatically utilizing the programmed SLS 260, or remotely from a central control room. Note that functional testing of a conventional wellhead shutdown system is not included within the scope of this invention.

Also illustrated is a local fault indicator 266 which, in certain embodiments, includes a light and an audible alarm. The alarm can also be transmitted via wired circuits or wirelessly to a remote control room to determine whether any additional action is required to continue the safe operation of the system. As described herein, certain specific fault indicators can also be provided, which can substitute or supplement local fault indicator 266. Alarms from any fault indicators described herein can also be transmitted via wired circuits or wirelessly to a remote control room to determine whether any additional action is required to continue the safe operation of associated components.

During normal operations, the pressure transmitters 252, 254 and 256 monitor flowline pressure for any unusual variations that may require a safety response; the pressure transmitter 270 which is downstream of the ZV is a non-safety related transmitter that is used to monitor flowline pressure during ZV 220 testing. The percentage of closure of ZV 220 is generally based on the detected differential pressure measured between the pressure transmitter 270 and pressure transmitters 252, 254 and 256. Partial stroking of ZV 220 avoids complete closure of ZV 220 and interruption of production.

It will be understood that the SLS 260 includes a pre-programmed functional test protocol without the need for personnel involvement in the step-by-step effectuation of the test. The programmed safety test includes timed intervals of predetermined length and the immediate initiation of one of predetermined alternative actions in the event that specified conditions are not met within the clocked interval. As will be understood by one of ordinary skill in the art, the conduct of such tests by personnel using visual observation methods and step-by-step personnel-controlled procedures, stopwatches, and the like cannot compare with the timeliness and accuracy of a programmed protocol. The functional tests can be initiated remotely from a control room; automatically by the predetermined periodic initiation of the test, e.g., monthly at a specified time and date in accordance with the program installed on the safety logic solver; or by field personnel using the push button 264.

The SLS 260 includes as a protocol a pre-programmed set of diagnostic tests that are conducted on-line of all the final elements used for flowline protection including all ESPs 230 and associated VSCs 240, and ZV 220 at the production header. The system and method of the invention provides for an end-to-end functional safety check of the complete system, including ESPs 230 within each wellhead sub-system 202, ZV 220 at the common production header, a plurality of sensors 252, 254 and 256 upstream of ZV 220, and sensor 270 downstream of ZV 220. In addition, the SLS 260 itself can also be tested during the functional test, in that the ability of the SLS to receive information from the sensors and to command action to the final elements is verified.

Upon initiation of the function test at the wellhead site, e.g., manually with a push button or other switch, or electronically from a remote location, actuator 222 receives a signal to initiate closing of the valve 220. The SLS 260 initiates a controlled partial stroke of the ZV 220 from the open position to a test position. The test position is verified by the differential pressure measured across ZV 220. A signal is transmitted by switch 224 upon movement of the valve from the fully opened position.

While ZV 220 is traveling from the open to the test position, valve response data (position vs. time) is collected and stored by SLS 260. This data, known as the valve signature, can be used to diagnose changes in the valve performance that can indicate degraded performance and a potential for failure. If the valve fails to move or excess delay is indicated, an alarm is initiated by the SLS 260 and annunciated locally, e.g., using local fault indicator 266 and ZV fault indicator light, to indicate that the system failed the functional test.

When the ZV 220 approaches the test position as verified by the development of differential pressure measured within SLS 260, e.g., by the difference in pressure measured between pressure sensors 250 and pressure sensor 270, the pressure sensors 250 will indicate an increase in pressure in the production header because each ESP 230 is now running against the partially closed ZV 220. In addition, the pressure is monitored using pressure sensor 270 downstream of the partially closed valve 220 for an increase in differential pressure across ZV 220 to verify proper valve seating and valve stem position.

Once the "final" valve stroke limit is reached, a predetermined test period is initiated by the SLS 260 during which the pressure increase is monitored. Signals from the pressure transmitters 252, 254, 256 are monitored for detection of a pressure increase.

When the predetermined pressure value or increase is detected, the SLS 260 will send a command to VSC 240 to reduce the speed of ESP 230 within each well. Note that the normal operating pressure of each ESP 230 is recorded within the SLS 260 prior to commencing the ESP speed reduction sequence. Once the first incremental ESP speed reduction command is given, a verification signal indicating that each well ESP VSC 230 responded is transmitted. Should any well ESP VSC 230 fail to respond, the test is aborted and the well ESP is identified on as one of the fault indicators 231 included on the SLS 260 panel. If a pressure decrease is not detected within the production header, the test is aborted and a "test failed" alarm is initiated. In this test protocol, it is not necessary to verify a ZV "tight shutoff." However, the ability to act on the process and develop an increase in pressure in the upstream piping is a sufficient functional test for the safety application of the present invention.

Once the ZV 220 reaches the "test" position, and the flowline pressure increase is successfully detected, the SLS 260 sends a command signal to each of the ESP variable speed controllers 240 to ramp down the speed of the ESPs 230. In certain embodiments, this command signal is sent at the same time and specifying the same ramp down rate increment for each VSC 240. Each VSC 240 response the initial ramp down increment from the SLS 260 is verified prior to continuing to reduce the speed of ESPs 230. Starting with the output from the SLS 260 to ESP VSCs 240, incremental speed reductions are made for a predetermined time period to detect a decrease in pressure in line 214 based upon data received from the pressure transmitters 252, 254 and 256. If a decrease in pressure is not detected during the time allotted or when the minimum ESP speed limit reached, SLS 260 will return VSCs 240 to the normal operating speed, open ZV 220, and initiate a "test failed" alarm. Using diagnostic protocols for each VSC 240 and the panel mounted fault indicators 231, a field technician can determine which VSC 240 did not respond during a failed system test and take corrective action.

If a pressure decrease is detected that meets or exceeds the predefined target, VSCs 240 are deemed to have passed the functional test, including verification of the fact that VSCs 240 are properly responding to commands from SLS 260. Thus, the test method includes the ability to decrease the pump speed, detect the pressure drop upstream of the partially closed ZV 220, and return the pump speed to normal for each ESP 230.

Following the verification of a production header pressure drop in excess of the predefined target, SLS 260 will transmit a signal to return partially closed ZV 220 to the fully open position. A predetermined time period is provided for ZV 220 to initiate movement from the partially closed test position. Should ZV 220 fail to move before the time period elapses, SLS 260 will issue a fault alarm, e.g., via ZV fault indicator 221, and all ESPs 230 will remain at the reduced test speed.

When SLS 260 receives a signal from the limit switch 222 and/or ZV smart valve controller indicating that ZV 220 has moved from the partially closed test position to the open position, a signal is transmitted to the variable speed controllers 240 to ramp up the speed of the ESPs 230 to provide the desired normal operating flowline pressure as verified by pressure transmitter 270. A check is made of all VSCs 240 to verify that each controller returned to the normal operating speed recorded at the start of the test sequence.

Accordingly, using the protocol of SLS 260, all components that constitute the safety instrumented system (SIS), including the pressure sensors, and the diverse outputs, e.g., ZV 220 and VSCs 240, are tested. In addition, the SLS 260 itself can also be tested during the functional test, in that the ability of the SLS to receive information from the sensors and to command action to the final elements is verified.

In certain embodiments of the systems and processes of the present invention, performance characteristics of ESPs 230, e.g., efficiency, flow rate and the like, need not be measured. Rather, it is the overall response of ESPs 230 to the programmed signals transmitted from SLS 260, e.g., sensed pressure within the production header, that are determinative of the condition of the safety system. The individual ESP VSC speed feedback is preferably used only as "safety related" diagnostic parameters within the online functional test sequence. The flowline pressure is sensed with "safety-critical" pressure transmitters 250 upstream of the ZV 220. Signals from the pressure sensors 250 are transmitted to the SLS 260 for a determination of whether the pumps 230 are responding within acceptable limits to the command signals from the SLS 260.

In the event that a safety demand signal is generated during the ZV partial-stroke test or the pump speed ramp test, the emergency shutdown trip signal will override the test sequence protocol and bring each pump 230 to a full stop and stroke the ZV 220 to the fully closed position.

It will be understood that the fault indicators on the local control panel will provide an alarm and register a time-stamped fault in the memory of the safety logic solver in the event that the associated device fails to function properly during the functional test sequence. Faults diagnosed and displayed will include individual well ESP VSCs (upon lack of response to SLS demand), lack of pressure increase detected by 252, 254 and 256 as the ZV 220 is moved to the "test" position or lack of pressure decrease detected after the slowing of the pump speed has been signaled to each of VSDs 240. Other diagnostics include delays in valve travel from either the open or partially closed test positions that exceed the predefined time limit.

Should an emergency shutdown signal be received by SLS 260, e.g., as a result of tripping of the push button 262 by personnel at the site, or the transmission via wire or wirelessly, of an emergency shut down signal, the conduct of the safety and fault test is immediately overridden and the SLS 260 sends a signal to reduce the speed of each ESP 230 to fully stopped and to fully close ZV 220. In certain embodiments, an emergency ESP shut-off switch is provided to interrupt power to the ESP 230.

In additional embodiments, the ESP variable speed drives 240 are included in the emergency shut down program so that the speed of each ESP 230 is slowed to the fully stopped point rather than an interruption of power to the ESP and VSC. This reduces the potential for any adverse impact on the pumps 230 that might occur by simply switching off the power.

In addition, during an emergency shutdown condition, the safety logic solver 260 provides an output to the conventional wellhead shutdown system that provides positive well individual isolation via the SSV valve actuator 274 and SSSV actuator 282 installed at each wellhead.

SLS 260 is also programmed to recognize the defect or failure of the single sensor 252, 254, 256 or 270 and alert maintenance personnel via one of the pressure sensor indicators 251 or a pressure sensor indicator 271, e.g. an audible and/or visible alarm, text message to operating personnel, or other known safety procedures. During any such time as when a sensor is in a known failure mode, the system converts to a voted one-out-of-two protocol.

Furthermore, SLS 260 is programmed to receive and record data on predetermined performance characteristics of one or more of the components selected from the ZV, pressure sensors, each ESP and each VSC during the functional safety test. The performance characteristics of the one or more components are compared by SLS 260 with existing standards. Comparative data can be displayed and/or transmitted to a central control room.

Figure 4:
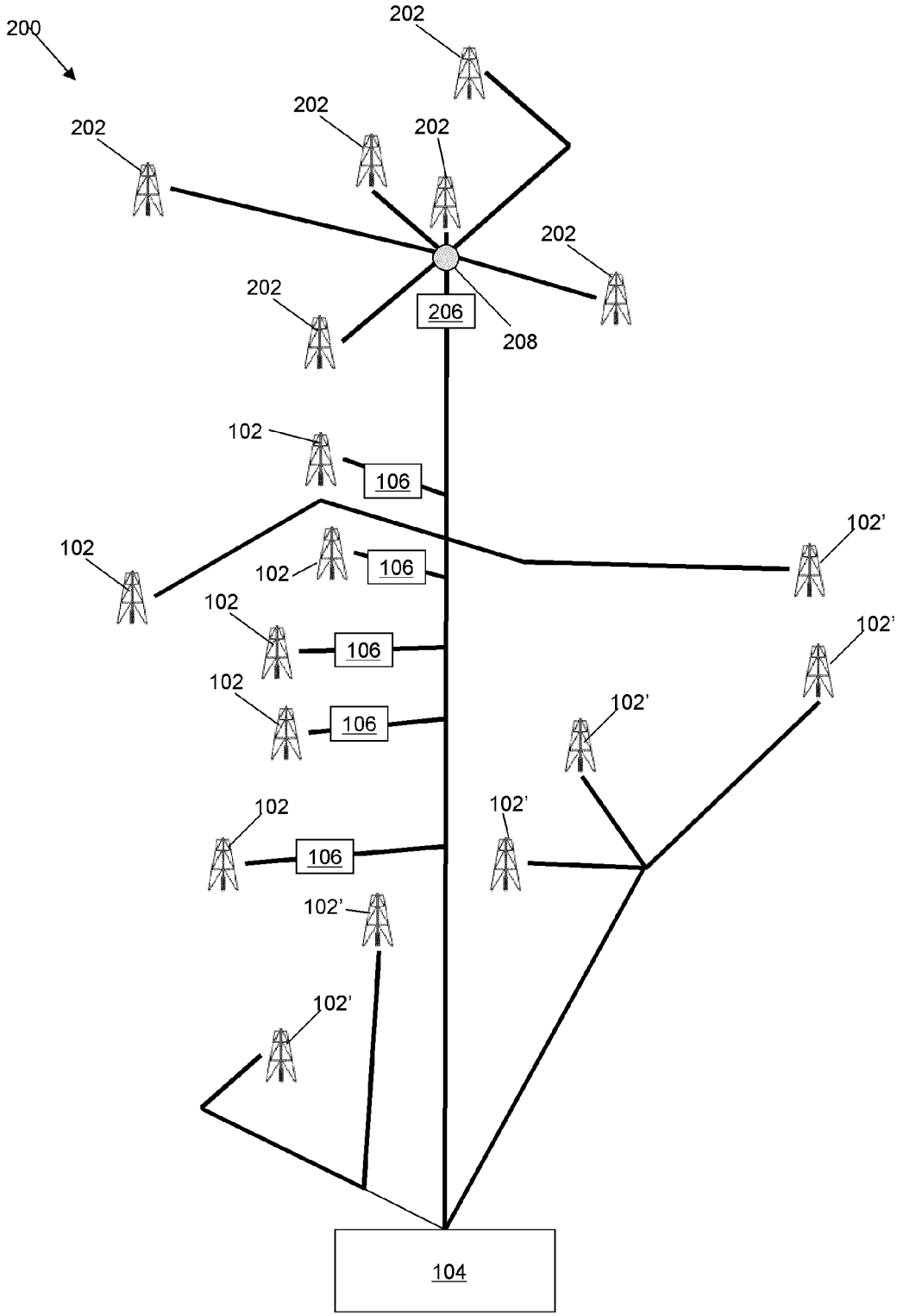
FIG. 4 is a schematic illustration of a plurality of wellheads connected to a common trunkline in which certain wellheads include the wellhead high integrity protection system of FIGS. 3.

Referring now to FIG. 4, a system 200 includes a plurality of wellhead sub-systems 202, 102 and 102' that are typically connected to a common trunkline to transport the oil/gas to a gas oil separation plant (GOSP) 104. Wellhead sub-systems 202 are connected to the common header 208, for instance, as described with reference to FIG. 3. The high integrity protection system 206, including an SLS, pressure transmitters and ZV, is positioned downstream of the common header 208.

As described with respect to FIG. 3, high pressure rated piping is used between the wells and the ZV of the HIPS 206, and conventional piping is used downstream of the ZV of the HIPS 206, which is rated for a pressure less than the maximum topside ESP blocked discharge pressure and suitable for the transportation and distribution of the product.

In addition, wellhead sub-systems 102 can also be provided which each include associated therewith a HIPS 106, e.g., including an SLS, pressure transmitters, and an SSV as shown in FIG. 1. In certain systems 200, additional wellhead sub-systems 102' are provided that do not show an associated HIPS 106, although other protection and/or safety systems can be used for these wellheads as is within the ordinary skill of one in the art.

Figure 5:
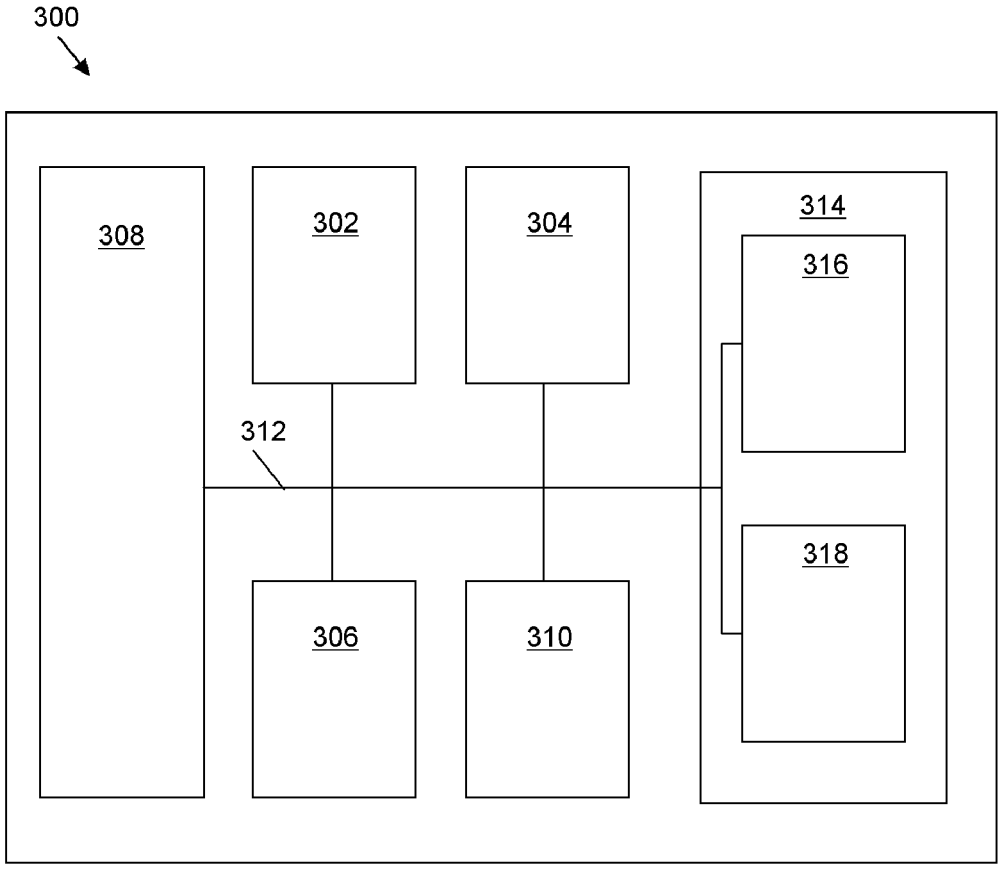
FIG. 5 is a block diagram of a computer system in which protocols and pre-programmed sets of diagnostic tests carried out by safety logic solvers are implemented as modules.

The various protocols and pre-programmed sets of diagnostic tests carried out by the safety logic solvers described herein can be implemented as modules in a programmed computer medium. An exemplary block diagram of a computer system 300 by which the modules of the present invention can be implemented is shown in FIG. 5. Computer system 300 includes a processor 302, such as a central processing unit, an input/output interface 304 and support circuitry 306. In certain embodiments, where the computer 300 requires a direct human interface, a display 308 and an input device 310 such as a keyboard, mouse or pointer are also provided. The display 308, input device 310, processor 302, and support circuitry 306 are shown connected to a bus 312 which also connects to a memory 314. Memory 314 includes program storage memory 316 and data storage memory 318. Note that while computer 300 is depicted with direct human interface components display 308 and input device 310, programming of modules and exportation of data can alternatively be accomplished over the interface 304, for instance, where the computer 300 is connected to a network and the programming and display operations occur on another associated computer, or via a detachable input device as is known with respect to interfacing programmable logic controllers.

Program storage memory 316 and data storage memory 318 can each comprise volatile (RAM) and non-volatile (ROM) memory units and can also comprise hard disk and backup storage capacity, and both program storage memory 316 and data storage memory 318 can be embodied in a single memory device or separated in plural memory devices. Program storage memory 316 stores modules for carrying out the protocols and sets of diagnostic tests described herein. Data storage memory 318 stores, for instance, data generated during functional testing such as valve signature data and time-stamped fault data generated by the one or more modules of the present invention.

It is to be appreciated that the computer system 300 can be any computer such as a personal computer, minicomputer, workstation, mainframe, a dedicated controller such as a programmable logic controller, or a combination thereof. While the computer system 300 is shown, for illustration purposes, as a single computer unit, the system can comprise a group/farm of computers which can be scaled depending on the processing load and database size.

The computing device 300 typically supports an operating system, for example stored in program storage memory 316 and executed by the processor 302 from volatile memory. According to an embodiment of the invention, the operating system interacts with one or more modules containing instructions for interfacing the device 300 to the pressure sensors, emergency isolation valve or safety shut-off valve (SSV), and final elements.

In the systems and processes of the present invention, the performance characteristics of the pump, e.g., efficiency, flow rate and the like, need not be measured. Rather, it is the overall response of the pump(s) to the programmed signals transmitted from the safety logic solver that are determinative of the condition of the safety system. The individual ESP VSC speed feedback is used only as "safety related" diagnostic parameters within the functional test sequence. The flowline pressure is sensed with safety-critical pressure transmitters, either upstream of the SSV in systems in which a high integrity protection system is associated with a single well having an ESP, or sensed upstream of the ZV within the production header in a high integrity protection system that is associated with a plurality of wells each having an ESP. Signals from the pressure sensors are transmitted to the safety logic solver for a determination of whether the pump or pumps are responding within acceptable limits to the command signals from the safety logic solver.

It will be understood from the above description that the system verifies the functioning of the sensors to detect flowline pressure changes, the logic solver to monitor those signals, the ESP variable speed drive controller to reduce the speed of the pump, and the SSV or ZV to isolate the flow of oil/gas from the downstream flowline network. In the system of the invention, an embodiment of a ZV actuator is an electric fail-safe device with a spring return. The functioning of the safety logic solver is verified by the proper operation of the final elements and through monitoring of pressure changes via the dedicated sensors.

Should a fault be detected with the valve, pump speed controller, or sensors, personnel are alerted and can take appropriate steps to perform the required maintenance without an adverse impact on safety or operations. In the multiple ESP well application, individual well ESP VSC feedback provides verification that each ESP VSC responded during the on-line functional test. Most importantly, the invention provides a safety instrument system (SIS) for a HIPS that can be completely tested on-line without interrupting the oil/gas production through the flowline during the test protocol and that can respond immediately to shut down the ESP(s) and SSV or ZV, should that become necessary.

In certain embodiments, the system of the invention factory built and tested, and can be skid-mounted with flange connections on the input and output of the flow piping system for ease of modular installation in the field. The consistent use of the same design also has the advantage of reducing the burden on operations and maintenance personnel in the performance of routine system safety testing over the installed life of the modular units.

The present invention thus provides a wellhead high integrity protection system that protects flowlines connected to a wellhead from overpressure should a downstream block valve close. In the system of the present invention, the pressure source is the downhole electrical submersible pump, or ESP, which is used when the topside (surface) pressure of a well decreases to a point where the well will no longer "free flow" or the topside pressures are not adequate to transport the oil/gas to a gas oil separation plant (GOSP) located farther away from the producing wellhead location.

The method and system of the present invention have been described above and in the attached drawings; however, modifications will be apparent to those of ordinary skill in the art and the scope of protection for the invention is to be defined by the claims that follow.

The invention claimed is:

1. An automated system for the safety testing of a trunkline instrumented protection system connected to a plurality of wellhead piping flowlines employed for the distribution of a fluid stream of gas and/or oil, at least one wellhead piping flowline of the plurality of wellhead piping flowlines pressurized by a downhole electric submersible pump (ESP), the system comprising:

a. a common header for a plurality of wellhead piping flowlines;

b. an emergency isolation valve (ZV) positioned in a trunkline downstream of the common header;

c. a pre-programmed safety logic solver (SLS) for conducting a safety test protocol and recording the results electronically, and for issuing emergency shut-down signals;

d. at least one pressure sensor for measuring the internal trunkline pressure in the common header upstream of the ZV and at least one pressure sensor for measuring the internal trunkline pressure downstream of the ZV;

e. a valve actuator for partially closing the ZV in response to a test-initiating signal or for closing the ZV in response to an emergency shut-down signal transmitted by the SLS, and for opening the ZV in response to a signal transmitted by the SLS; and f. a variable speed drive controller operatively connected to each ESP and the SLS for varying the speed of the ESP based upon incremental speed reduction/increase commands from the SLS to thereby varying the pressure of the fluid in the flowline, and for providing feedback of the speed of the ESP during normal operations and during system testing to the SLS.

2. The system of claim 1 which further includes a signal transmitting valve actuator limit switch or smart valve controller operatively connected to the ZV and in communication with the SLS; and an alarm that is actuated if the actuator limit switch or smart valve controller does not issue a signal after the passage of a predetermined period of time following transmission of a signal by the SLS to the ZV to initiate opening or closing.

3. The system of claim 2 which includes means for actuating the alarm when no change in the pressure of the plurality of wellhead piping flowlines is transmitted by the plurality of sensors within a predetermined period of time following transmission by the SLS of a signal to the ZV to initiate a closing or opening cycle.

4. The system of claim 1 in which the ZV is provided with an electrically-operated fail-safe actuator with a positive spring return.

5. The system of claim 1 in which the variable speed drive controller for each ESP is adapted to reduce the speed of the associated ESP to the stopped point in response to an emergency shut-down signal from the SLS.

6. The system of claim 1 further comprising an emergency ESP shut-off switch for interrupting power to each ESP in response to an emergency shut-down signal from the SLS.

7. The system of claim 1 in which the wellhead piping flowlines and the trunkline piping up to and including the common header is rated for a maximum operating pressure that corresponds to the maximum wellhead shut-in pressure.

8. The system of claim 7, which includes an alarm that is actuated if the values of the pressure sensor signals processed by the SLS vary by more than a predetermined value.

9. The system of claim 1 which includes three pressure transmitting sensors operatively connected to the SLS, wherein pressure in the common header is determined by voting the sensor signal values in a two-out-of-three protocol.

10. The system of claim 1 which includes a means for independently transmitting an overriding emergency shut-down signal to each ESP that takes precedence over any active safety test that is in process, whereby each ESP is shutdown in response to the emergency shutdown signal.

11. The system of claim 1 in which the SLS is programmed to issue control signals to the ZV and each variable speed drive controller based on the flowline pressure as transmitted from the pressure sensing transmitters.

12. The system of claim 1, further wherein feedback from individual variable speed controllers is used by the SLS for the purposes of diagnostic indication of faults during system testing.

13. A method for the safety and fault testing of a trunkline instrumented protection system connected to a plurality of wellhead piping flowlines carrying gas and/or oil that are each pressurized by a downhole electric submersible pump (ESP), the trunkline being equipped with an emergency isolation valve (ZV), the method comprising:

a. providing at least one pressure sensor on the trunkline upstream of the ZV and at least one pressure sensor on the trunkline downstream of the ZV;

b. providing a variable speed controller (VSC) for each ESP for adjusting the speed of the ESP;

c. providing a programmed safety logic solver (SLS) that is in control communication with the ZV and each variable speed controller for each ESP, and that receives and records data transmitted by the pressure sensors;

d. initiating a safety and fault test from the SLS by transmitting a signal to the ZV to initiate movement to its partially closed position based on differential pressure measurements made across the valve;

e. monitoring the pressure data received from the pressure sensors;

f. transmitting a signal from the SLS to each VSC to reduce the speed of each ESP in response to a predetermined increase of internal trunkline pressure;

g. communicating ESP VSD speed feedback to the SLS once a predefined speed reduction increment is initiated to identify any individual well ESP VSC that failed to respond to the SLS during the system testing;

h. transmitting a signal from the SLS to move the ZV to its fully-opened position; and i. transmitting a signal from the SLS to each VSC to increase the speed of the ESP in response to trunkline pressure data.

14. The method of claim 13, wherein a plurality of pressure sensors are provided upstream of the ZV.

15. The method of claim 14 in which the data from the plurality of pressure sensors upstream of the ZV is voted by the SLS.

16. The method of claim 14 which includes monitoring the variance in pressure data received by the SLS and initiating a fault alarm if the difference in the data from one of the pressure sensors when compared to that of the other pressure sensors upstream of the ZV exceeds a predetermined value.

17. The method of claim 13 which further comprises receiving and recording data on predetermined performance characteristics of one or more of the components selected from the ZV, pressure sensors, each ESP and each VSC during the safety test, comparing the respective component's performance characteristics with existing standards, and providing a display of the comparative data and/or transmitting the comparative data to a central control room.

18. The method of claim 13 which includes terminating the safety and fault test in response to an emergency signal received by the SLS, and simultaneously transmitting signals to move the ZV to its fully closed position and to shut down each ESP.

19. The method of claim 13 which includes initiating a failed test alarm in the event that trunkline pressure does not increase following transmission of the SLS signal to partially close the ZV.

20. The method of claim 13 which includes initiating a failed test alarm if trunkline pressure does not decrease following the transmission of the SLS signal to reduce the speed of each ESP in step (f) and initiating a fault indicator on the local control panel that identifies any individual ESP VSC that did not respond to the prescribed demands of the safety logic solver during system testing.

21. The method of claim 13 which includes transmitting a shutdown signal from the SLS to each ESP if no reduction in trunkline pressure is detected after transmission of the signal to open the ZV.

22. The method of claim 13 which further includes:

providing the ZV with a signal transmitting valve actuator limit switch and smart valve controller that transmits a fully-opened, fully-closed signal and continuous valve position to the SLS;

initiating a time clock in the SLS when a signal is transmitted to close and/or open the ZV; and initiating a failed test alarm and ZV fault if no movement is signaled by the limit switch after a predetermined period of time moving from the open position or from the partially closed test position.

* * * * *